US010132470B2

(12) United States Patent
Jurik et al.

(10) Patent No.: US 10,132,470 B2
(45) Date of Patent: Nov. 20, 2018

(54) VERSATILE BEAM AND WASH OPTICAL SYSTEM FOR AN AUTOMATED LUMINAIRE

(75) Inventors: Pavel Jurik, Prostredni Becva (CZ); Josef Valchar, Prostredni Becva (CZ)

(73) Assignee: Robe Lighting s.r.o., Roznov pod Radhostem (CZ)

( * ) Notice: Subject to any disclaimer, the term of this patent is extended or adjusted under 35 U.S.C. 154(b) by 0 days.

(21) Appl. No.: 13/398,802

(22) Filed: Feb. 16, 2012

(65) Prior Publication Data

US 2013/0058094 A1 Mar. 7, 2013

Related U.S. Application Data

(60) Provisional application No. 61/531,062, filed on Sep. 5, 2011, provisional application No. 61/599,420, filed on Feb. 15, 2012.

(51) Int. Cl.

| | |
|---|---|
| ***F21S 6/00*** | (2006.01) |
| ***F21V 11/18*** | (2006.01) |
| ***F21V 5/04*** | (2006.01) |
| ***F21V 14/06*** | (2006.01) |
| ***F21V 11/14*** | (2006.01) |
| *F21S 10/00* | (2006.01) |
| *F21W 131/406* | (2006.01) |

(52) U.S. Cl.
CPC ..... *F21V 11/183* (2013.01); *F21V 5/045* (2013.01); *F21V 11/14* (2013.01); *F21V 14/06* (2013.01); *F21S 10/007* (2013.01); *F21W 2131/406* (2013.01)

(58) Field of Classification Search
USPC ..... 362/277
See application file for complete search history.

(56) References Cited

U.S. PATENT DOCUMENTS

2010/0008088 A1* 1/2010 Koizumi et al. ..... 362/235

* cited by examiner

*Primary Examiner* — Anh Mai
*Assistant Examiner* — Brenitra M Lee
(74) *Attorney, Agent, or Firm* — Conley Rose, P.C.; Grant Rodolph; Brooks W Taylor

(57) ABSTRACT

Described are an improved automated luminaire 12 and luminaire systems 10 employing an improved output Fresnel lens 46 with an optically planar surface 34 combined with an articulable stippling plate 47. The stippling plate 47 may be inserted and removed immediately behind and adjacent to the planar rear surface of the lens 46 in order to transform the optical system from beam optics to wash optics or immediately adjacent to another articulable lens system 29 directly the light beam toward the previously described Fresnel lens. Further embodiment may include an articulable beam spreader.

7 Claims, 11 Drawing Sheets

VERSATILE BEAM AND WASH OPTICAL SYSTEM FOR AN AUTOMATED LUMINAIRE

RELATED APPLICATIONS

This application is a full utility patent application claiming priority of provisional patent application(s) 61/531,062 filed 5 Sep. 2011 and 61/599,420 filed 15 Feb. 2012.

TECHNICAL FIELD OF THE INVENTION

The present invention generally relates to automated luminaires, specifically to optical systems for use within automated luminaires.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Show Lighting such as the ColorSpot 700E are typical of the art.

The optical systems of such automated luminaires may be designed such that a very narrow output beam is produced so that the units may be used with long throws or for almost parallel light laser like effects. These optics are often called 'Beam' optics. To form this narrow beam the output lens either needs to be very large with a large separation between the lens and the gobos or of a short focal length and much closer to the gobos. It is problematic to use a large separation with a large lens as such an arrangement makes the luminaire large and unwieldy and makes automation of the pan and tilt movement difficult. Thus the normal solution is a closer and smaller lens with a short focal length. A short focal length lens if constructed as a conventional glass plano-convex lens needs to be very thick and heavy which may also cause problems with the center of gravity of the luminaire, especially if the lens is moved along the optical axis by motors to provide an automated focus function. As the heavy lens moves the center of gravity of the luminaire is constantly changing and causes problems for the automated pan and tilt systems which are optimized for a balanced mechanical load. Prior art manufacturers may attempt to remedy this problem in one of two ways. Firstly they may maintain the heavy front lens static and instead move the gobo, iris and shutter assemblies backwards and forwards instead. Although these assemblies are also heavy they are closer to the center of gravity of the luminaire so that moving them has less affect on the overall balance. Alternatively the thick heavy plano-convex front lens may be replaced with a Fresnel lens where the same focal length is achieved with a much lighter molded glass lens using multiple circumferential facets. Fresnel lenses are well known in the art and can provide a good match to the focal length of an equivalent plano-convex lens, however the image projected by such a lens is typically soft edged and fuzzy and not a sharp image as may be desired. This softness may be caused by the facets on the molded glass Fresnel lens; there are relatively few facets and each one has an edge which, instead of being sharp, is constrained by the molding process and the surface tension of the molten glass during molding to instead have a large radius of curvature. This radius on the tip of each circumferential facet tends to diffuse the light beam and produce a softened image.

Prior art beam optical systems may also be unforgiving when it is desired to soften the image and produce a light output capable of being blended between units to provide seamless coverage. This mode of operation is often called a "wash light" as it washes the stage with light. Prior art systems will commonly insert a further optical element(s) such as a frost glass or secondary lens(es) before the final output lens in order to provide this wash distribution. However, such systems often do not provide the ideal light distribution, as a frosted out image is different from the light pattern from a "true" wash light. Further, using a frost or diffusing filter reduces the light output of the luminaire considerably. Additionally a problem with using a secondary lens is that the output lens may not then be filled completely and all the light will appear to be emitted from a portion at the centre of the output lens a "hot spot". This reduces the performance of the luminaire as a wash light as it is an important feature of wash luminaires that the effective light source be as large as possible in order to soften and reduce shadowing.

FIG. 1 illustrates a multiparameter automated luminaire system 10. These systems commonly include a plurality of multiparameter automated luminaires 12 which typically each contain on-board a light source, light modulation devices, electric motors coupled to mechanical drives systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15.

FIG. 2 illustrates a prior art automated luminaire 11 designed as a beamlight in contrast to a wash light. A lamp 21 contains a light source 22 which emits light. The light is reflected and controlled by reflector 20 through optical devices 26 which may include dichroic color filters, effects glass and other optical devices well known in the art and then through an aperture or imaging gate 24. Optical components 27 are the imaging components and may include gobos, rotating gobos, iris and framing shutters. The final output beam may be transmitted through output lens 31. Lens 31 may be a short focal length glass lens or equivalent Fresnel lens as described herein. Either optical components 27 or lens 31 may be moved backwards and forwards along the optical axis to provide focus adjustment for the imaging components. A frost or diffusing filter may optionally be included as one of the optical components 26 or 27 such that the output of the beam is diffused to emulate a wash light.

There is a need for an improved output lens system for an automated luminaire which provides the user selectable option of either a narrow beam output with sharply focused images or a wash light distribution with a large effective source and true blending output distribution.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration of the optical systems within such a luminaire to provide the user selectable option of either a narrow beam output with sharply focused images or a wash light distribution with a large effective source and true blending output distribution.

Figure 1:
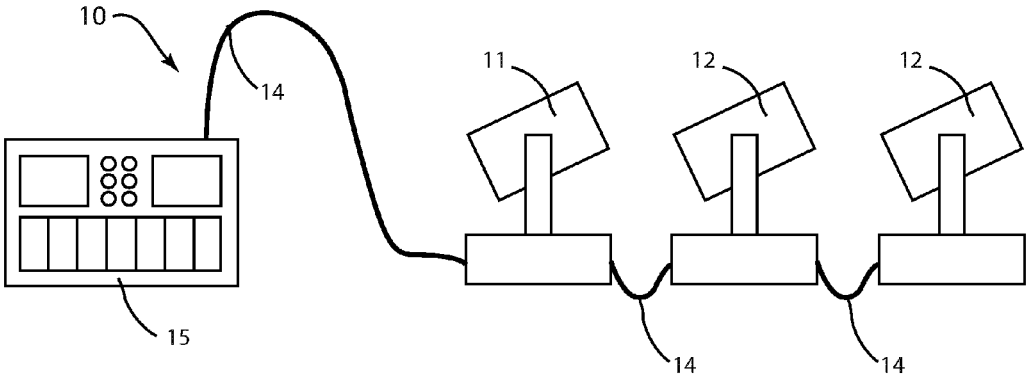
FIG. 1 illustrates a typical automated lighting system.
Figure 2:
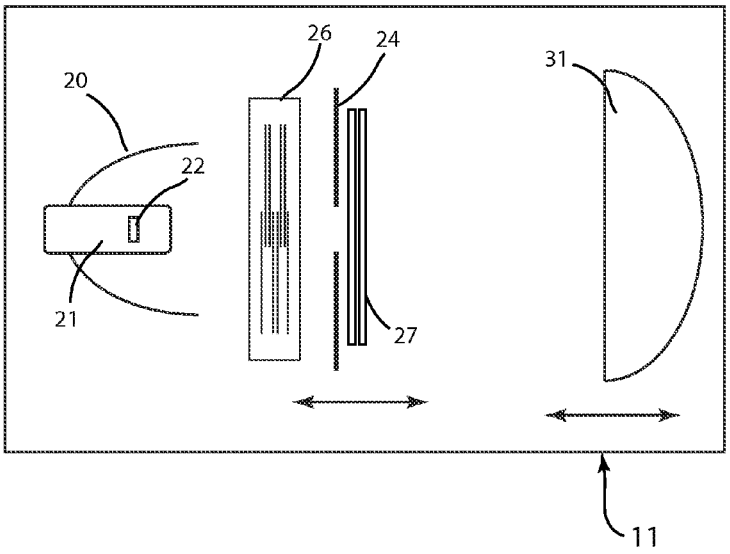
FIG. 2 illustrates a prior art automated luminaire.
Figure 3:
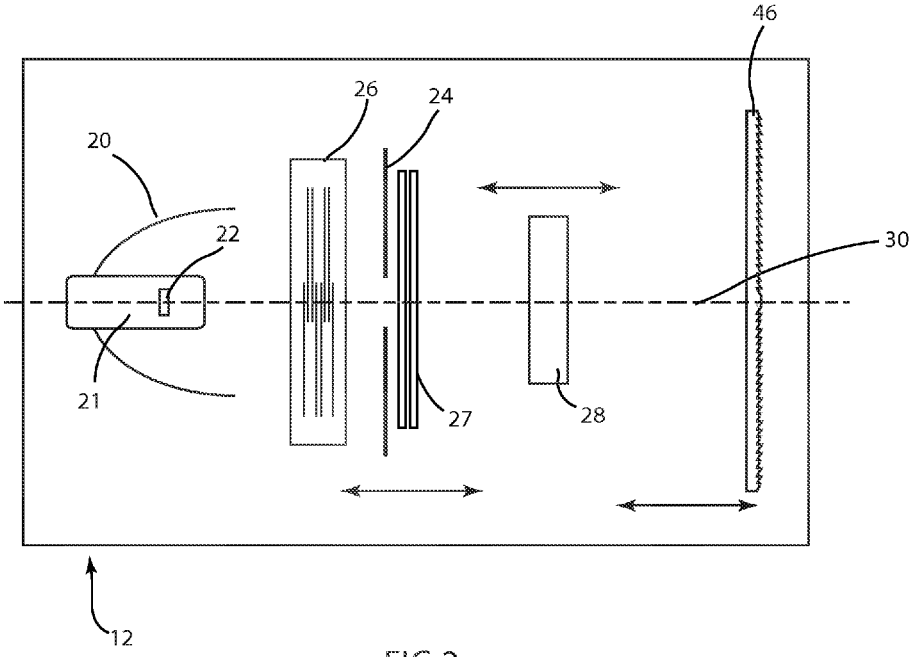
FIG. 3 illustrates an embodiment of an improved Fresnel output lens luminaire in beamlight mode.

FIG. 3 illustrates an embodiment of an improved Fresnel output lens luminaire when in beam light mode. Automated luminaire 12 may contain a lamp 21 and reflector 20 where the lamp and reflector may be moved relative to each other for beam hot-spot control, color control components 26 which may include, but are not limited to, color mixing flags or wheels, color wheels and other dichroic color control components, an aperture 24, imaging optical components 27 which may include but are not limited to gobos, rotating gobos, shutters, beam shapers, variable frost filters, prisms and iris. The light beam from these images is focused by optical assembly 28 and Fresnel output lens 46. Optical assembly 28 may comprise one or more optical elements all or some of which may be moved backwards and forwards along the optical axis 30 of the luminaire 12 so as to direct light towards output lens 46. Optical assembly 28 may further homogenize and constrain the light beam and ensure that the light beam entirely fills output lens 46. Output lens 46 may be the improved Fresnel lens 46 illustrated in FIG. 5. Lens 46 may be moved backwards and forwards along the optical axis 30 of the luminaire 12 so as to provide focus adjustment of the projected images of optical elements 27. The combination of optical assembly 28 and output lens 46 provides an output beam which is emitted from the entire surface of output lens 46, is capable of very narrow angle, almost parallel, output, and avoids an external secondary focus point in the beam.

Figure 5:
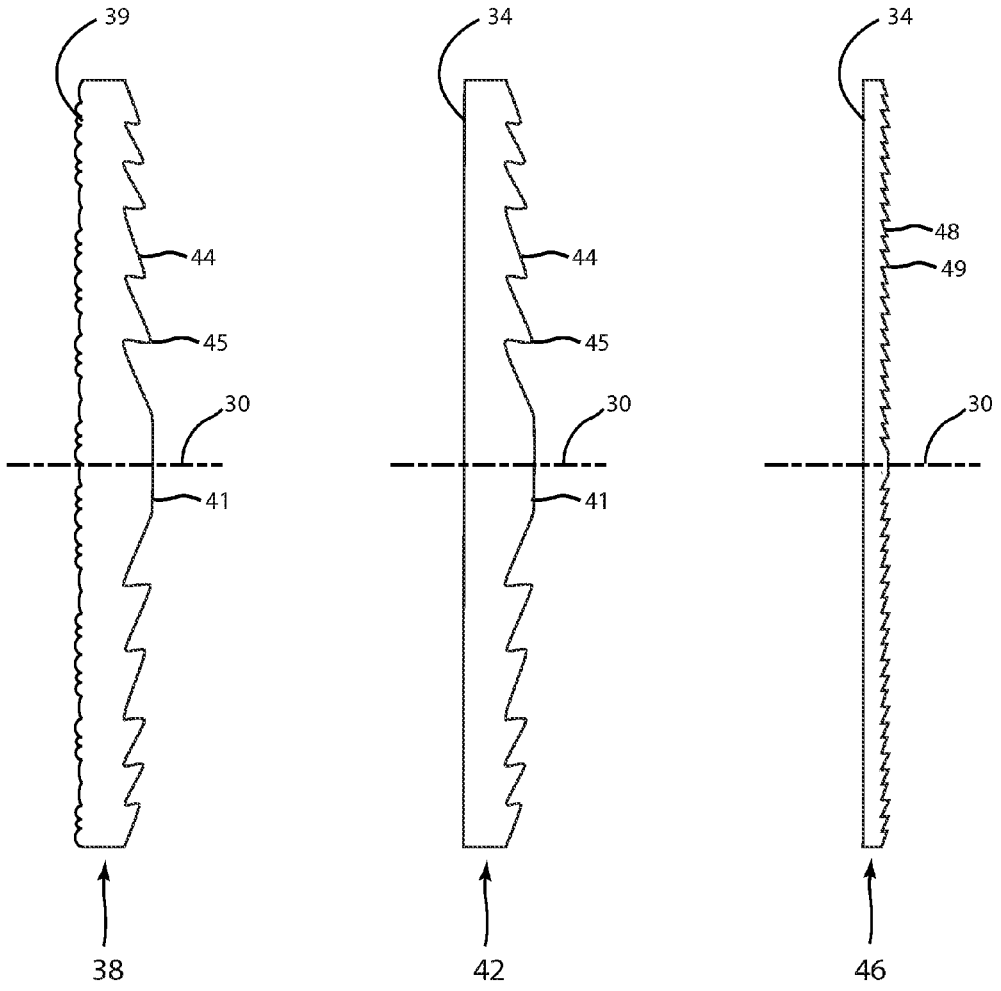
FIG. 5 illustrates an embodiment of a Fresnel lens for an improved luminaire.

FIG. 5 illustrates Fresnel lens 38 used in the prior art and embodiments of improved Fresnel lens used in the embodiments of the described improved luminaire. Output lens may be a conventional Fresnel lens 42 or may be a Fresnel lens 46 with a greatly increased number of circumferential facets 48 compared to the faceted surface 41 of the Fresnel lens 38 illustrated in FIG. 5. The front surface 41 of the lenses 38 and 42 is typical of a prior art Fresnel lens for a luminaire application and may typically comprise 10-15 circumferential facets 44 in a 150 mm diameter lens whereas in an embodiment of the invention the improved Fresnel lens 46 may comprise twice or more the number of circumferential facets 48. In one embodiment the Fresnel lens comprises approximately 100 circumferential facets 48. This substantial increase in the number of circumferential facets serves to significantly improve the optical resolution of the lens and thus provide a sharper output image. Although not required by the invention, further improvement may be provided by the lens material and manufacture. A typical prior art Fresnel lens is manufactured of glass and suffers from surface tension effects during molding such that the tips of each facet, which should be sharply pointed, are rounded to a large radius 45. This radius causes unwanted scattering of the transmitted light and thus softens the projected image. An improved lens of the invention may be manufactured of a plastic or polymer through a molding process that provides significantly reduced radius of curvature on the pointed tips of the facets 49. This smaller radius of curvature significantly reduces light scattering from these tips and thus provides enhanced sharpness in the projected image. The choice of material as a polymer or plastic further serves to reduce the weight of lens 46.

A further improvement may be provided by altering the rear surface of the Fresnel lens. Prior art Fresnel lenses 38 also commonly have a break-up or stippling pattern 39 molded into the rear surface. This stippling serves to diffuse the image and thereby disguise defects of the lens—in particular the distortion effects caused by the facet tips 45. The stippling further softens the image and gives it a wash light like output with diffused shadows and soft images—in contrast to a beam light with more defined images. As further described below, the Fresnel lens in the improved luminaire does not include such stippling or break-up pattern(s)—the rear surface 34 of Fresnel lens 42 and Fresnel lens 46 are optically planar. This planar rear surface allows the luminaire to provide sharply focused output images and tight, narrow beams when desired. It is possible in further embodiments of the invention with less stringent requirements for image quality to use a more conventional glass Fresnel lens 42 with a smaller number of circumferential facets; however the rear surface 34 of such a Fresnel lens must be optically planar, such that it does not include stippling or break-up pattern(s).

Figure 4:
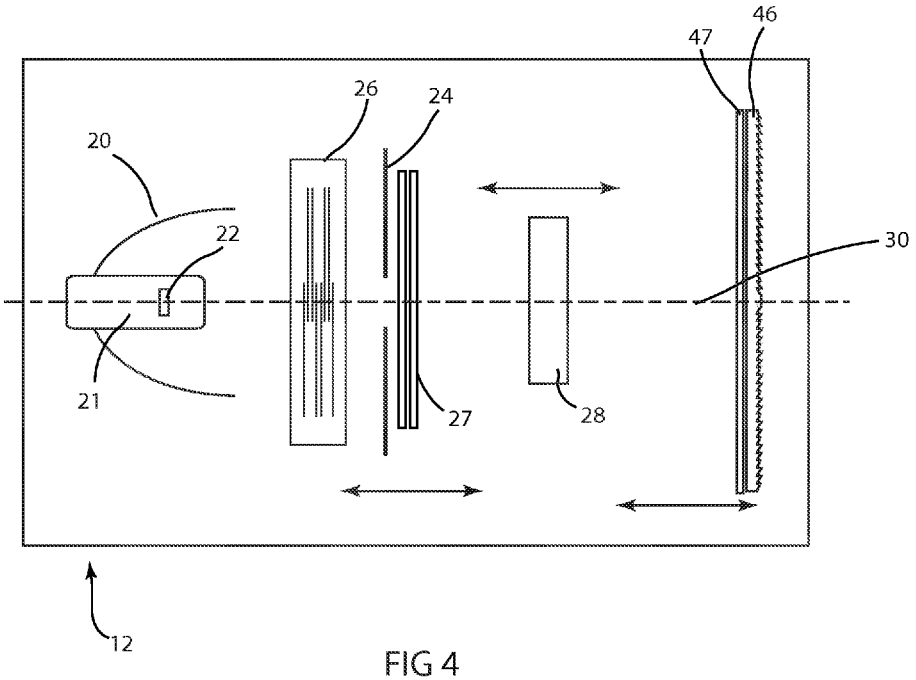
FIG. 4 illustrates an embodiment of an improved Fresnel output lens luminaire in wash light mode.

FIG. 4 illustrates an embodiment of the improved luminaire 12 in wash light mode. In this mode a stippling lens plate(s) 47 has been added (moved into position) immediately behind and adjacent to the Fresnel lens 46.

Figure 6:
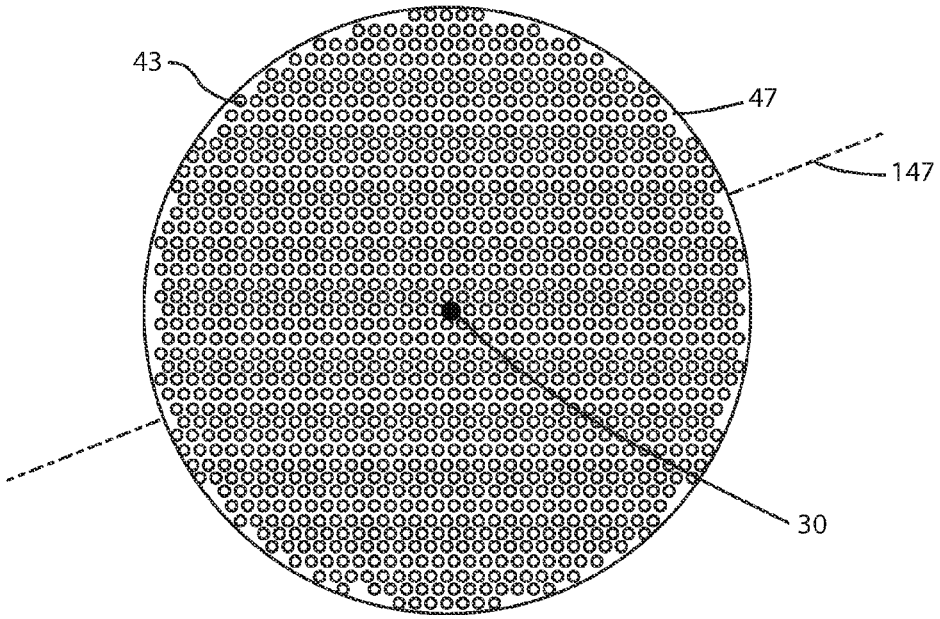
FIG. 6 illustrates a front view of an embodiment of the stippling lens plate from FIG. 5.
Figure 7:
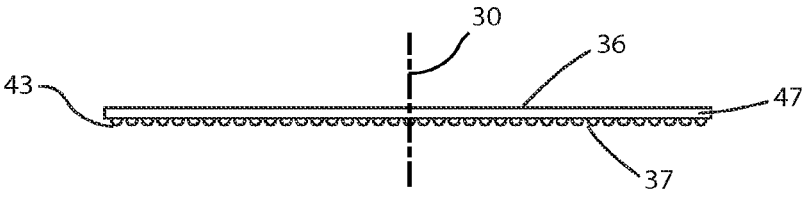
FIG. 7 illustrates a cross-sectional view stippling lens plate illustrated in FIG. 6.

An embodiment of a stippling lens plate 47 is further illustrated in greater detail in FIG. 6 and FIG. 7. In the embodiment shown the stippling lens is a flat, thin optical plate constructed either of glass, or suitable transparent polymer such as acrylic or polycarbonate. FIG. 6 illustrates a front view of the stippling lens plate down the optical axis 30 of the luminaire. FIG. 7 is a cross-sectional view of stippling lens plate 47 along section 147 indicated in FIG. 6. In the embodiment shown, The stippling lens plate 47 has one planar surface 36 and one stippled or break-up surface 37 containing a pattern of lenslets 43 or other break-up pattern as well known in the art. The lenslets 43 are illustrated here as circular but the invention is not so limited and lenslets 43 may be any shape or configuration so as to break-up or stipple the image. In operation the stippling lens plate 47 is placed adjacent to the planar surface 34 of Fresnel lens 46. In this configuration, with the stippling lens plate 47 and Fresnel lens 46 close to each other, the combination behaves substantially as if it were a single optical element. The combination optical element Fresnel lens 46 and stippling lens 47 will produce a soft-edged beam with the true blending light distribution required by a wash light.

The combination has the further advantage over prior art systems that the combination is optically efficient—the two elements 46 and 47 are very close to each other so the majority of the light that is distributed by the stippling lens plate 47 enters the Fresnel lens 46 and there is very little light loss.

A yet further advantage is that the stippling system provides identical results at all beam angles and the system will continue to work as the optical system is zoomed by moving the combination of lens 46 and stippling lens plate 47 backwards and forwards along the optical axis 30. As in the spot configuration optical assembly 28 may comprise one or more optical elements some of which may be moved backwards and forwards along the optical axis 30 of the luminaire 12 so as to direct light towards output lens 46. The combination of optical assembly 28 and output lens 46 provides an output beam which is emitted from the entire surface of output lens 46, is capable of very narrow angle, almost parallel, output, and avoids an external secondary focus point in the beam.

In some embodiments the optically planar surface 36 of the stippling lens plate(s) 37 face the optically planar surface 34 of the Fresnel lens 46. In other embodiment the stippled lenslets 43 surface of the stippling lens plate 37 faces the optically planar surface 34 of the Fresnel lens 46.

Various means for inserting and removing the stippling lens plate 37 behind and adjacent to the Fresnel lens are illustrated in various embodiments in FIGS. 8&9, 10&11, 12&13, and/or 20&21. The invention is not limited to these means and any means of inserting and removing the stippling lens plate as well known in the art should be considered. The stippling lens plate may be inserted and removed in a single piece or may be divided into multiple pieces without affecting its optical properties to aid its insertion and removal, and to minimize the space taken up by the stippling lens plate when it is removed from the beam.

Figure 8:
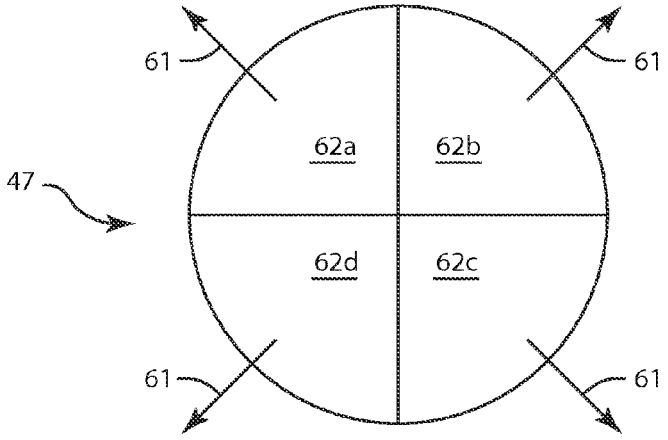
FIGS. 8 & 9 illustrate the movement of an embodiment of a partitioned stippling lens plate.
Figure 9:
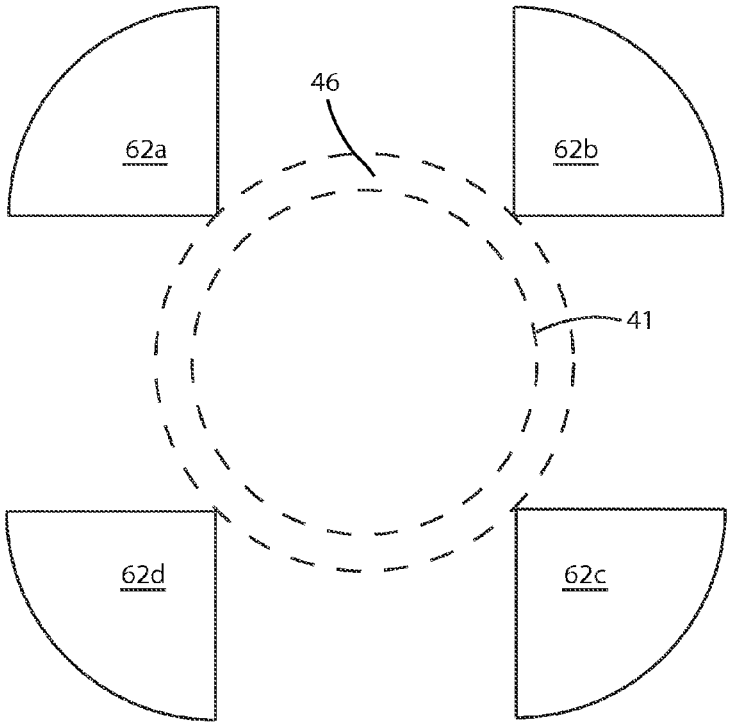

FIGS. 8 and 9 illustrate the movement of the stippling lens plate 47 in an embodiment of the invention. In FIG. 8 the stippling lens plate 47 has been divided into four quarters, 62*a*, 62*b*, 62*c* and 62*d*. Each of these four quarters may be moved radially out of the light path 41 and away from behind Fresnel lens 46 in the directions shown by the arrows 61.

FIG. 9 shows the four quarters, 62*a*, 62*b*, 62*c* and 62*d*, of the stippling lens plate 47 after they have been moved out of the light path 41, fully exposing the rear of Fresnel lens 46. The movement of the stippling lens plate quarters 62*a*, 62*b*, 62*c* and 62*d* may be through mechanical linkages (not shown) driven by stepper motors (not shown) or other means as well known in the art.

Figure 10:
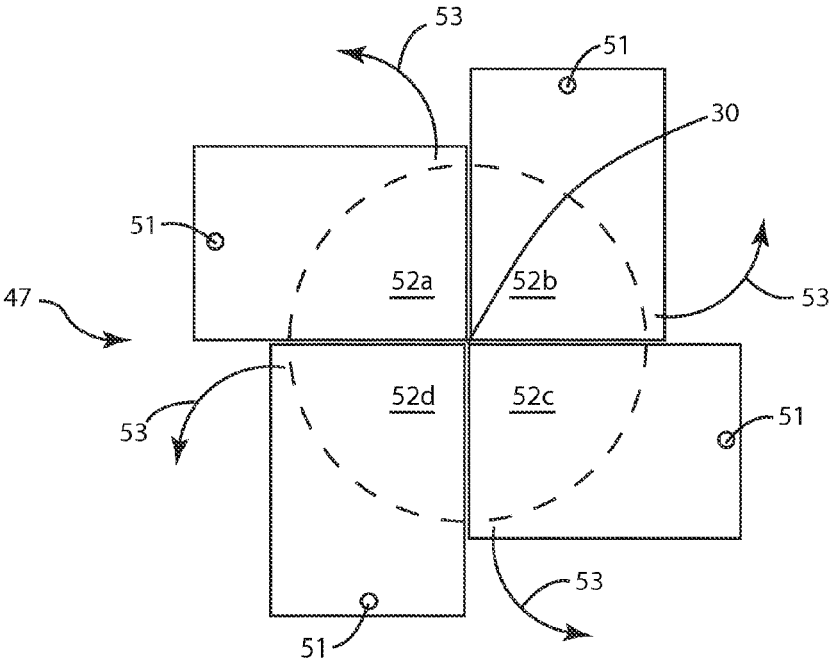
FIGS. 10 & 11 illustrate the movement of an alternative embodiment of a partitioned stippling plate lens in an embodiment of the invention.
Figure 11:
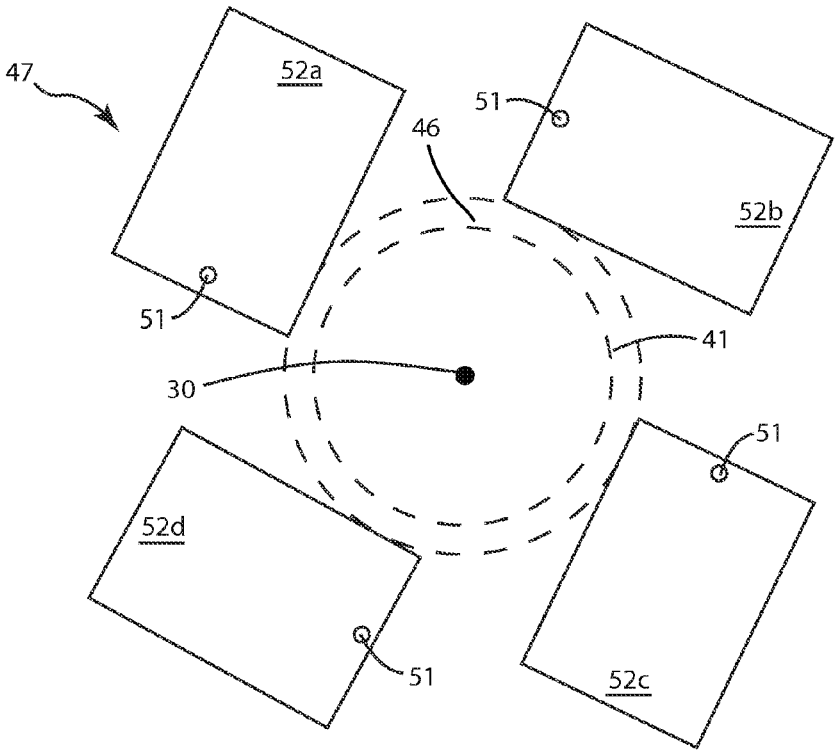

FIGS. 10 and 11 illustrate a further example of the movement of the stippling lens plate 47 in an embodiment of the improved luminaire. In FIG. 10 the stippling lens plate 47 has been divided into four flags, 52*a*, 52*b*, 52*c* and 52*d*. Each of these four flags 52*a*, 52*b*, 52*c* and 52*d* may be rotated about four rotating axes 51 (one for each flag 52*a*, 52*b*, 52*c* and 52*d*) out of the light path 41 and away from behind Fresnel lens 46 in the directions shown by the arrows 53.

FIG. 11 shows the four flags, 52*a*, 52*b*, 52*c* and 52*d*, of the stippling lens plate 47 after they have been rotated out of the light path 41, fully exposing the rear of Fresnel lens 46. The movement of the stippling lens plate flags may be through mechanical linkages (not shown) driven by stepper motors (not shown) or other means as well known in the art.

Figure 12:
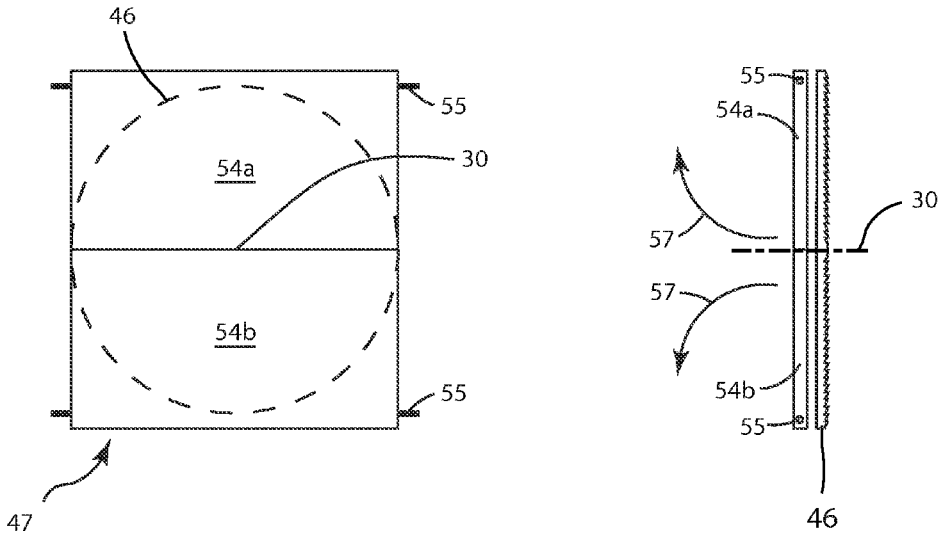
FIGS. 12 &13 illustrate the movement of another alternative embodiment of a partitioned stippling lens plate.
Figure 13:
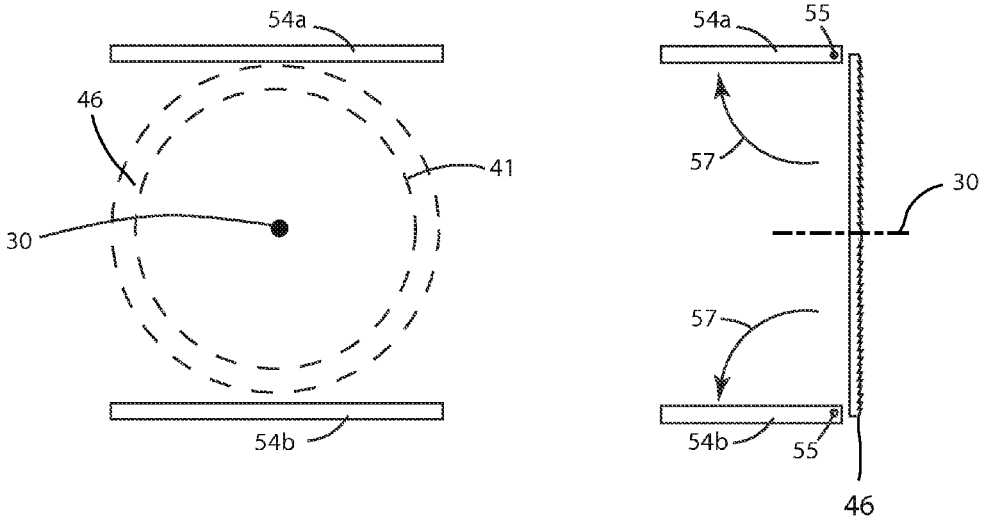

FIGS. 12 and 13 illustrate both plan (front) and elevation (side) views of a further example of the movement of the stippling lens plate in an embodiment of the invention. In FIG. 12 the stippling lens plate 47 has been divided into two halves, 54*a*, and 54*b*. Each of these two halves may be rotated about pivots 55 out of the plane of the light path 41 and away from behind Fresnel lens 46 in the direction shown by the arrows 57. This movement is like lifting and opening the pages of a book. FIG. 12 shows the two halves, 54*a*, and 54*b*, of the stippling lens plate 47 after they have been lifted and rotated out of the light path, fully exposing the rear of Fresnel lens 46. The movement of the stippling lens plate halves may be through mechanical linkages driven by stepper motors or other means as well known in the art.

Figure 20:
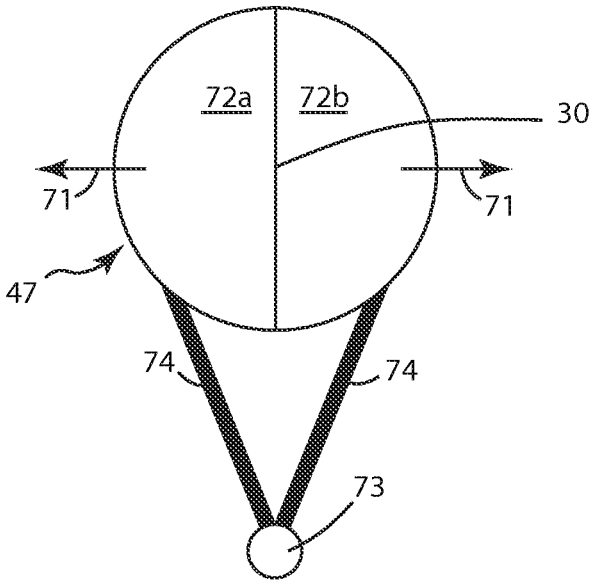
Figure 21:
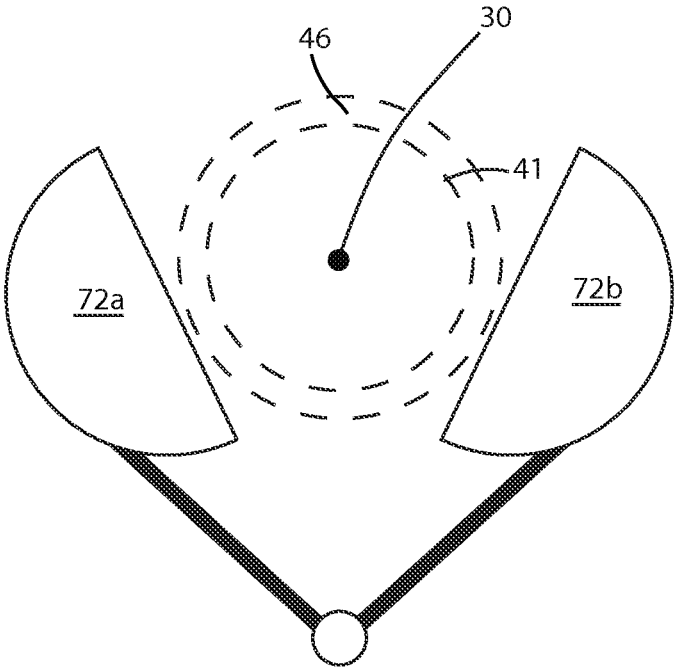

FIGS. 20 and 21 illustrate a further alternative embodiment of the movement of the stippling lens plate(s) 47 in an embodiment of the invention. In FIG. 20 the stippling lens plate 47 has been divided into two halves, 72*a* and 72*b*. Each of these two halves may be swung out of the light path 41 and away from behind Fresnel lens 46 in the directions shown by the arrows 71 through the contra rotation of shafts 73 and connecting arms 74. Shafts 73 may be driven by a stepper motor (not shown). Such mechanisms are well known in the art.

Figure 14:
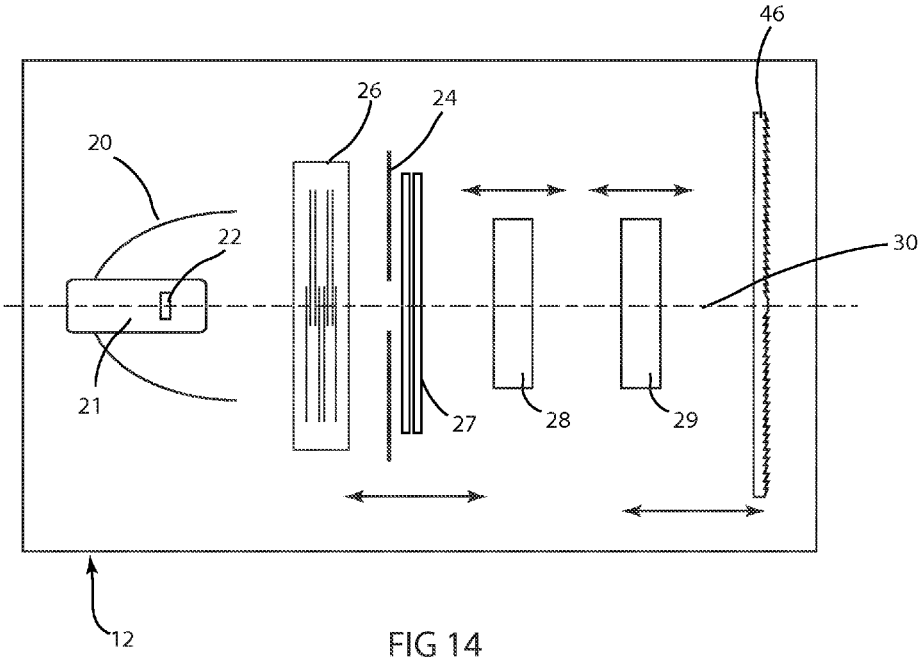
FIG. 14 illustrates an alternative embodiment of an improved Fresnel output lens luminaire in beamlight mode.

FIG. 14 illustrates a further embodiment of the invention when in beam light mode. Automated luminaire 12 may contain a lamp 21 and reflector 20 where the lamp and reflector may be moved relative to each other for beam hot-spot control, color control components 26 which may include but are not limited to color mixing flags or wheels, color wheels and other dichroic color control components, an aperture 24, imaging optical components 27 which may include but are not limited to gobos, rotating gobos, shutters, beam shapers, variable frost filters, prisms and iris. The light beam from these images is focused by first optical assembly 28, second optical assembly 29, and output lens 46. First optical assembly 28 and second optical assembly 29 may each comprise one or more optical elements and some of which may be moved backwards and forwards along the optical axis 30 of the luminaire 12 so as to direct light towards output lens 46. First optical assembly 28 and second optical assembly 29 may further homogenize and constrain the light beam and ensure that the light beam substantially fills output lens 46. Output lens 46 may be the improved Fresnel lens 46 illustrated in FIG. 5. First optical assembly 28, second optical assembly 29 and lens 46 may be moved backwards and forwards along the optical axis 30 of the luminaire 12 so as to provide focus and beam angle adjustment of the projected images of optical elements 27. The combination of first optical assembly 28, second optical assembly 29, and output lens 46 provides an output beam which is emitted from substantially the entire surface of output lens 46, is capable of very narrow angle, almost parallel, output, and avoids an external secondary focus point in the beam.

Figure 15:
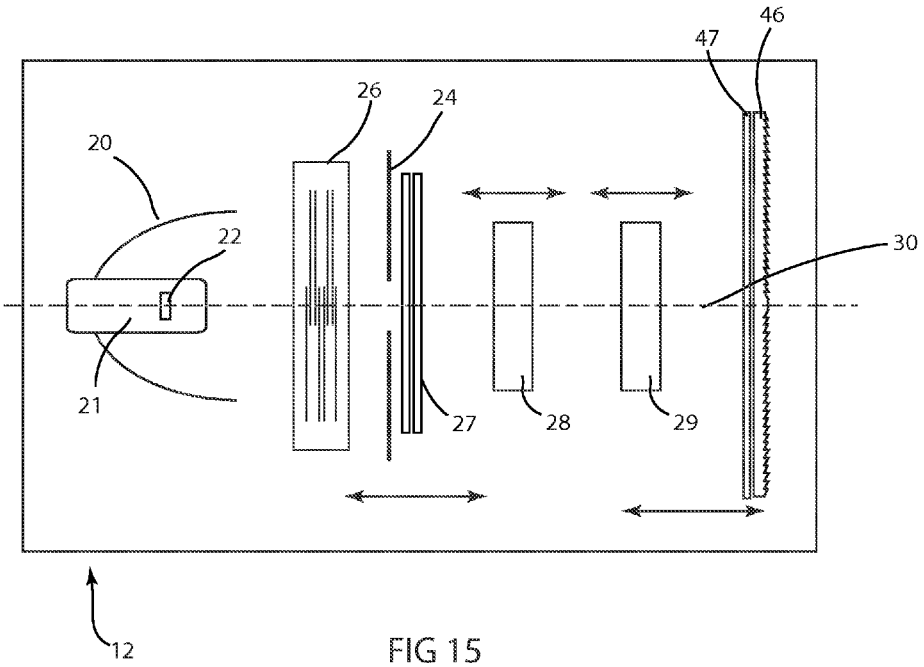
FIG. 15 illustrates an embodiment of an improved Fresnel output lens luminaire in wash light mode.

FIG. 15 illustrates the further embodiment of the improved luminaire 12 in wash light mode. In this mode a stippling lens plate 47 has been added (moved into position) immediately behind and adjacent to the Fresnel lens 46. The combination optical element Fresnel lens 46 and stippling lens 47 will produce a soft-edged beam with the true blending light distribution required by a wash light. As in the spot configuration illustrated in FIG. 14 (stippling lens not in the beam path) first optical assembly 28 and second optical assembly 29 may each comprise one or more optical elements some of which may be moved backwards and forwards along the optical axis 30 of the luminaire 12 so as to direct light towards output lens 46. The combination of first optical assembly 28, second optical assembly 29, and output lens 46 provides an output beam which is emitted from the entire surface of output lens 46, is capable of very narrow angle, almost parallel, output, and avoids an external secondary focus point in the beam.

In some embodiments the optically planar surface 36 of the stippling lens plate(s) 37 face the optically planar surface 34 of the Fresnel lens 46. In other embodiment the stippled lenslet 43 surface of the stippling lens plate 37 faces the optically planar surface 34 of the Fresnel lens 46.

Figure 16:
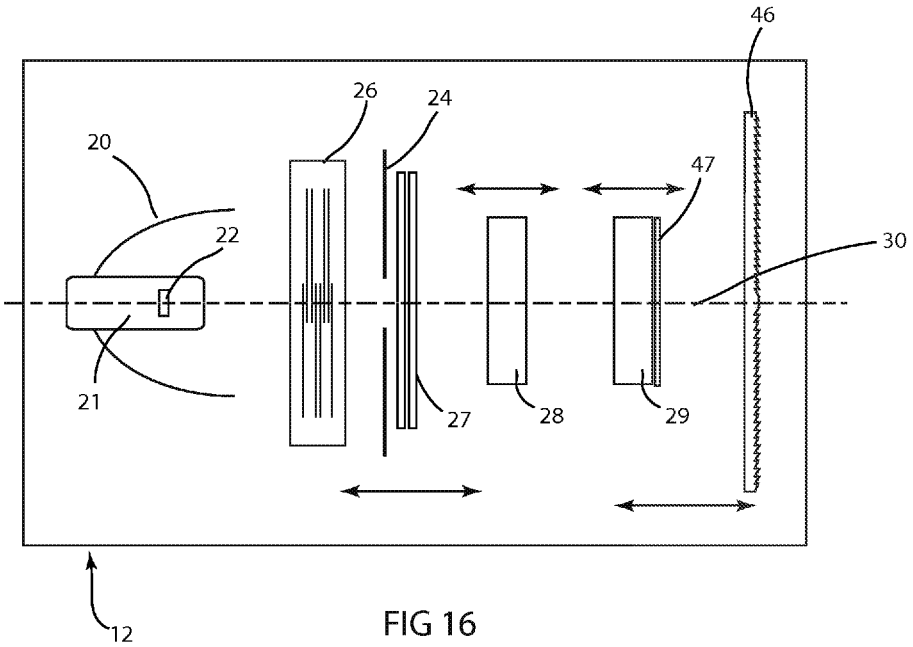
FIG. 16 illustrates an embodiment of an improved Fresnel output lens luminaire in wash light mode.

FIG. 16 illustrates an alternative embodiment of the improved luminaire 12 shown in FIG. 15 in wash light mode. In this embodiment the removable stippling lens plate(s) 47 has been added after second optical assembly 29, between that assembly and Fresnel lens 46. This configuration offers the same advantages as those discussed for FIG. 15 with the further advantage that stippling lens plate lens 47 may be smaller than Fresnel lens 46, a diameter closer to the size of the second optical assembly 29. Stippling lens plate 47 may be part of the same mechanical assembly as second optical assembly 29 and may move with it backwards and forwards along the optical axis 30 of the luminaire 12 as the focus and beam angle of the luminaire are adjusted. Various means for inserting and removing the stippling lens plate after second optical assembly 29 are similar to those illustrated in various embodiments in FIGS. 8&9, 10&11, 12&13, and/or 20&21. The invention is not limited to these means and any means of inserting and removing the stippling lens plate as well known in the art should be considered. The stippling lens plate may be inserted and removed as a single piece or may be divided into multiple pieces without affecting its optical properties to aid its insertion and removal, and to minimize the space taken up by the stippling lens plate when it is removed from the beam.

In some embodiments the optically planar surface 36 of the stippling lens plate(s) 37 face lens set 29. In other embodiment the stippled lenslet 43 surface of the stippling lens plate 37 away from lens set 29.

Figure 17:
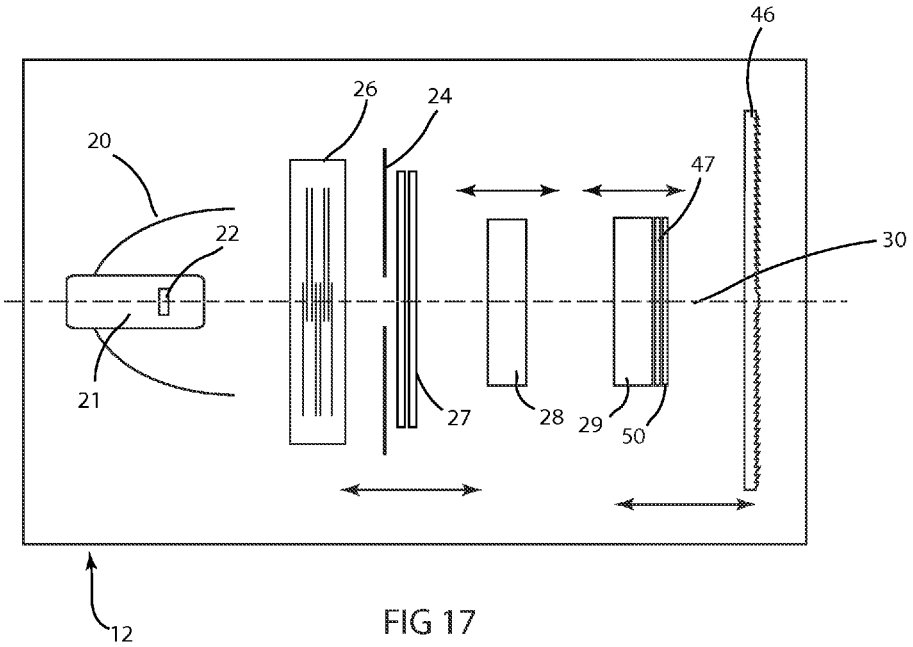
FIG. 17 illustrates an embodiment of an improved Fresnel output lens luminaire in wash light mode.

FIG. 17 illustrates an alternative embodiment of the improved luminaire 12 shown in FIG. 15 in wash light mode. In this embodiment a further removable diffusing plate 50 has been added after second optical assembly 29, between that assembly and Fresnel lens 46. Diffusing plate 50 may have a micro lens structure or be manufactured of a frosted or diffusing material, either glass or a polymer. Diffusing plate 50 may spread light through a greater angle than stippling lens plate 47 and may allow the luminaire to produce a wider output angle. Diffusing plate 50 may be added to the optical assembly instead of stippling lens plate 47 or in addition to stippling lens plate 47 to provide further combinational options on beam angle. Diffusing plate 50 may be part of the same mechanical assembly as second optical assembly 29 and may move with it backwards and forwards along the optical axis 30 of the luminaire 12 as the focus and beam angle of the luminaire are adjusted. Various means for inserting and removing the diffusing plate 50 after second optical assembly 29 are similar to those illustrated in various embodiments in FIGS. 8&9, 10&11, 12&13, and/or 20&21. The invention is not limited to these means and any means of inserting and removing the diffusing plate as well known in the art should be considered. The diffusing plate may be inserted and removed as a single piece or may be divided into multiple pieces without affecting its optical properties to aid its insertion and removal, and to minimize the space taken up by the diffusing plate when it is removed from the beam.

In some embodiments the optically planar surface 36 of the stippling lens plate(s) 37 face lens set 29. In other embodiment the stippled lenslet 43 surface of the stippling lens plate 47 away from lens set 29. In further embodiments rather than the stippling lens plate 47 being between the second lens set 29 and the diffusing plate 50, the diffusing plate 50 can be between the second lens set 29 and the stippling lens plate 47. In preferred embodiments these components, lens set 29, stippling lens plate 47 and diffusion plate 50 are tightly configured.

Figure 18:
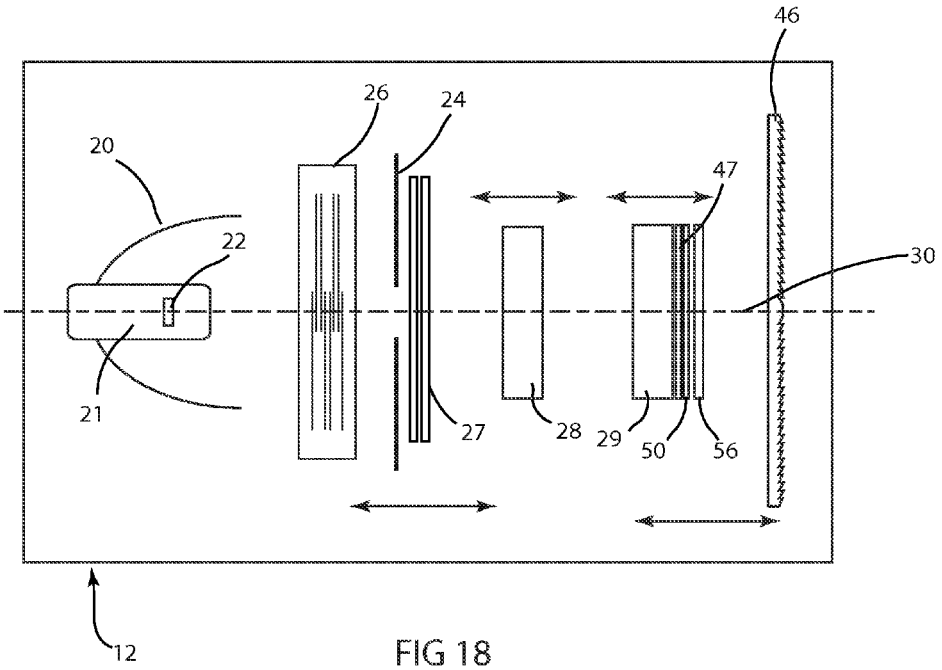
FIG. 18 illustrates an embodiment of an improved Fresnel output lens luminaire in wash light mode.

FIG. 18 illustrates an alternative embodiment of the improved luminaire 12 shown in FIG. 15 in wash light mode. In this embodiment a further removable beam spreader plate 56 has been added after second optical assembly 29, between that assembly and Fresnel lens 46. Beam spreader plate 56 may have an asymmetrical optical structure such that it spreads light in one axis more than in another. This may impart an oval shape to the resultant light beam with the asymmetry of the beam spreader plate affecting the eccentricity of the ellipse. Beam spreader plate 56 may have a lenticular or micro lens structure or be manufactured of a rippled, frosted or diffusing material, either glass or a polymer. Beam spreader plate 56 may be added to the optical assembly instead of stippling lens plate 47 and diffusing plate 50 or may be used in any combination with stippling lens plate 47 and diffusing plate 50 to provide further combinational options on beam angle and beam shape. Beam spreader plate 56 may be part of the same mechanical assembly as second optical assembly 29 and may move with it backwards and forwards along the optical axis 30 of the luminaire 12 as the focus and beam angle of the luminaire are adjusted. Various means for inserting and removing the beam spreader plate 56 after second optical assembly 29 are similar to those illustrated in various embodiments in FIGS. 8 & 9, 10 & 11, 12 & 13, and/or 20 & 21. The invention is not limited to these means and any means of inserting and removing the beam spreader plate as well known in the art should be considered. The beam spreader plate may be inserted and removed as a single piece or may be divided into multiple pieces without affecting its optical properties to aid its insertion and removal, and to minimize the space taken up by the beam spreader plate when it is removed from the beam. Beam spreader plate 56 may also be configures such that it may be rotated around the optical axis 30 of the luminaire 12. This rotation allows the resultant oval beam to be rotated as the user desires.

In some embodiments the optically planar surface 36 of the stippling lens plate(s) 37 face lens set 29. In other embodiment the stippled lenslet 43 surface of the stippling lens plate 47 away from lens set 29. In further embodiments the stippling lens plate 47, diffusion plate 50 and beam spreader 56 can appear in different order(s) after a lens set 29. In preferred embodiments these components, lens set 29, stippling lens plate 47, diffusion plate 50 and beam spreader 56 are tightly configured.

Figure 19:
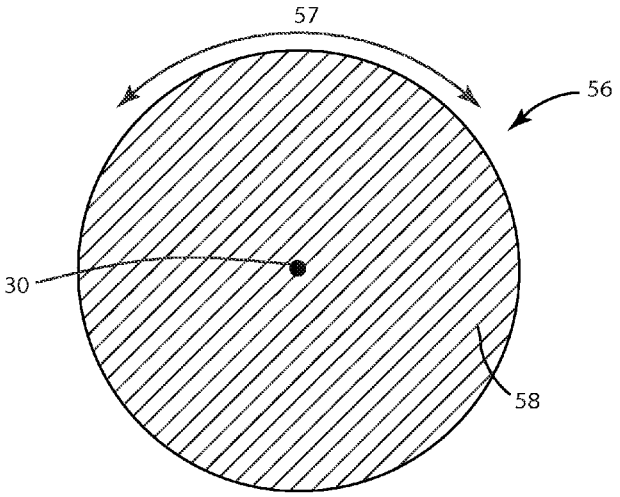
FIG. 19 illustrates in greater detail an embodiment of the beam shaper plate from FIG. 18, and, FIGS. 20 & 21 illustrate the movement of an alternative embodiment of a partitioned stippling lens plate in an embodiment of the invention.

FIG. 19 illustrates in greater detail an embodiment of a beam shaper plate 56 from FIG. 18. Beam shaper plate 57 may comprise a plurality of lenticular lens elements 58. Each lenticular lens element 58 will spread the light passing through the plate by a greater angle in a first direction, perpendicular to the lenticular axis, than in a second direction, parallel to the lenticular axis. This imparts an elliptical or oval shape to the resultant beam. Beam shaper plate 56 may be rotated 57 around the optical axis 30 so as to rotate this ellipse or oval as desired. As first optical element 28, second optical element 29, coupled beam shaping plate 56 and Fresnel lens 46 are moved backwards and forwards along optical axis 30, the elliptical or oval shaped beam may be reduced or increased in size. Means for actuating the movement of the beam shaper plate 56 are known in the art.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

The invention claimed is:

1. An automated luminaire generating a modulated light beam along a light beam axis comprising: a Fresnel lens with a planar rear surface a stipple plate with a planar front surface and a stippled rear surface mounted adjacent to the Fresnel lens so that the planar surface of the Fresnel lens is adjacent to the planar surface of the stippled plate; the stipple plate is articulated to be selectively removed from the light beam and inserted in the light beam adjacent to the Fresnel lens; the stipple lens is partitioned into a plurality of separate sections and the stipple lens partitions articulations incorporate a pivot about which the partitions are rotated from out of the light beam to a position in the light beam immediately adjacent to the Fresnel lens.

2. The automated luminaire of claim 1 wherein the Fresnel lens and stipple plate are selectively articulated to variable positions along a range along the light beam axis.

3. The automated luminaire of claim 1 wherein the pivots are positioned so that the potion rotational plane of the stipple lens partitions is in a plane perpendicular to the light beam axis.

4. An automated luminaire generating a modulated light beam along a light beam axis comprising: a Fresnel lens with a planar surface; a stipple plate with a planar surface facing the planar surface of the Fresnel lens and a stippled surface opposite the planar surface of the stippled plate; the planar surface of the Fresnel lens faces the light beam; wherein the Fresnel lens and stipple plate are selectively articulated to variable positions along a range along the light beam axis and the stipple lens partitions articulations incorporate a pivot about which the partitions are rotated from out of the light beam to a position in the light beam immediately adjacent to the Fresnel lens.

5. The automated luminaire of claim 1 where the stipple plate is articulated to be selectively removed from the light beam and inserted in the light beam adjacent to the Fresnel lens.

6. The automated luminaire of claim 1 wherein the stipple lens is partitioned into a plurality of separate sections.

7. The automated luminaire of claim 6 wherein the pivots are positioned so that the potion rotational plane of the stipple lens partitions is in a plane perpendicular to the light beam axis.

* * * * *